US008479647B1

(12) United States Patent
Gomez

(10) Patent No.: US 8,479,647 B1
(45) Date of Patent: Jul. 9, 2013

(54) SODA CAN CRUSHER

(71) Applicant: Edward B. Gomez, Azusa, CA (US)

(72) Inventor: Edward B. Gomez, Azusa, CA (US)

( * ) Notice: Subject to any disclaimer, the term of this patent is extended or adjusted under 35 U.S.C. 154(b) by 0 days.

(21) Appl. No.: 13/687,802

(22) Filed: Nov. 28, 2012

(51) Int. Cl.
*B30B 13/00* (2006.01)
*B30B 9/32* (2006.01)
*B30B 1/38* (2006.01)

(52) U.S. Cl.
USPC ..... 100/35; 100/345; 100/347; 100/215; 100/218; 100/269.01; 100/902

(58) Field of Classification Search
USPC ..... 100/35, 345, 347, 214, 215, 218, 100/269.01, 269.05, 902
See application file for complete search history.

(56) References Cited

U.S. PATENT DOCUMENTS 2,617,224 A * 11/1952 Kingsland et al. ..... 100/347
3,577,911 A * 5/1971 Morse ..... 100/347
3,916,780 A * 11/1975 Heiser ..... 100/49
4,489,649 A * 12/1984 Daugherty ..... 100/215
5,181,462 A * 1/1993 Isaac ..... 100/98 R
5,303,643 A * 4/1994 Fisher et al. ..... 100/51
5,331,888 A * 7/1994 Brown, Jr. ..... 100/125
7,806,047 B1 * 10/2010 Gomez ..... 100/216
2002/0083851 A1 * 7/2002 Gragg ..... 100/902

* cited by examiner

*Primary Examiner* — Jimmy T Nguyen
(74) *Attorney, Agent, or Firm* — Gary F. Wang, Esq.

(57) ABSTRACT

A can crushing apparatus for crushing a can is presented. The can crushing apparatus includes an elongated structure, a piston drive assembly, a can crushing chamber, a can holding plate, a deflector guide, a control, a safety switch, a push button switch and an attachment means. The piston drive assembly includes a piston designed to crush the can. The piston includes a hammer attached with a hammer plate and a cylindrical housing for securing the piston. The hammer is extendable in a downward direction and retractable in an upward direction. The deflector guide transfers a crushed can to a can collecting bin. The control provides electric power to the can crushing apparatus. The safety switch prevents hand injuries caused by the accidental positioning of hands by a user on the crusher.

15 Claims, 7 Drawing Sheets

SODA CAN CRUSHER

BACKGROUND OF THE DISCLOSURE

1. Technical Field of the Disclosure

This embodiment relates in general to soda can crushers. More specifically, the preferred embodiment relates to a can crushing apparatus having a safety mechanism to prevent hand injuries caused by the accidental positioning of hands on the crusher.

2. Description of the Related Art

A wide variety of can crushers have been developed in the art. Cans made of aluminum, steel and metal alloys can be easily crushed using the can crushers. The can crushers flatten cans filled with soda, beverages and other soft drinks Crushed cans are more convenient to transport for can recycling purposes and require only less space for storage. Different types of can crushers are available in the market. These include single can crusher, multi can crusher and garbage can crusher. Can crushers are very useful in public places like schools, colleges, hotels, malls, theatres and parks where sodas and other can filled beverages are sold on abundance. The can crushers help us to protect environment and natural resources by providing a convenient method for can recycling.

Various methods exist in order to optimize the process of can crushing. For example, U.S. Pat. No. 5,941,167 issued to Fleming on Aug. 24, 1999 provides a portable can compactor having a housing, a chamber designed to accept aluminum beverage cans for compacting. A ram is reciprocally driven in the chamber to compact cans against a front wall or anvil of the chamber. The ram front surface is sloped relative to the anvil to reduce the amount of force needed to compact a can. However, this can compactor is not wall mountable. Further, this device does not provide any safety mechanism to prevent a hand injury that occurs when a user or a child accidentally places his hand on any sharp edged component of the can compactor.

U.S. Pat. No. 5,038,677 issued to Wittman on Aug. 13, 1991 describes a can crusher for compacting cans, such as aluminum soft drink cans, into a substantially flat configuration for storage, recycling or disposal. The can crusher includes a base with opposing flanges and a handle that rotates about the flanges. The handle includes an extending crimping member that compresses the center of the can downwardly, and also forces the ends of the can inwardly. However, this can crusher utilizes a complex mode of operation for crushing the cans.

U.S. Pat. No. 4,570,536 issued to Dodd on Feb. 18, 1986 describes an electrically actuated can crusher having a housing, a motor mounted within the housing and a shaft rotatable by the motor and downwardly driven thereby having a crush plate thereon. The housing also includes a bottom crush plate for allowing a can to be placed in the housing between the crush plates. But, this can crusher has a complex construction and is very expensive.

U.S. Pat. No. 4,394,834 issued to Lowe on Jul. 26, 1983 provides a can crusher having a continuous incremental crushing action for reducing cans or similar containers to a compact size. The crusher consists of a housing having a cylindrical configuration with a cylindrical cavity for the horizontal attachment to a wall. Even so, the can crusher is designed to work manually and a user has to exert force for crushing the can.

Hence, it can be seen, that there is a need for a soda can crusher that would be simple in construction, reliable and easy to use. This needed device would not require a user to exert force for crushing a can. Further, such a needed device would utilize a simple mode of operation for crushing the can and would require less space for storage. Moreover, such a needed device would be inexpensive and wall mountable. Such a needed device would provide a safety mechanism to prevent hand injuries caused by the accidental positioning of hands on the crusher.

SUMMARY OF THE DISCLOSURE

To minimize the limitations found in the prior art, and to minimize other limitations that will be apparent upon the reading of the specifications, the present invention provides a can crushing apparatus designed to crush a can. The can crushing apparatus comprises an elongated structure, a piston drive assembly, a can crushing chamber, a can holding plate, a deflector guide, a control, a safety switch, a push button switch and an attachment means. The elongated structure includes a front wall, a rear wall, a pair of side walls, a top portion and a bottom portion. The piston drive assembly is attached with the front wall and includes a piston designed to crush the can. The piston includes a hammer attached with a hammer plate, a cylindrical housing for securing the piston, an upper portion and a lower portion. The hammer is extendable in a downward direction and retractable in an upward direction. The can crushing chamber is attached with the front wall and includes a door. The can holding plate is designed to hold the can. The deflector guide transfers a crushed can to a can collecting bin. The control provides electric power to the can crushing apparatus. The control includes an on/off switch for selectively turning the control on or off and further includes a cable for electrically connecting the control to an external power supply.

The safety switch is attached with the can crushing chamber. The safety switch includes a first safety tube and a second safety tube. The safety switch becomes activated when the door of the can crushing chamber becomes completely closed. Similarly, the safety switch becomes deactivated when the door is in an open condition. The safety switch is designed to activate the control for supplying the electric power to the can crushing apparatus. The push button switch is electrically connected to the safety switch through the second safety tube. The can crushing apparatus further comprises a first air tube having a first top end and a first bottom end, an air valve, a second air tube having a second top end and a second bottom end, a third air tube having a third top end and a third bottom end, a fourth air tube having a fourth top end and a fourth bottom end and a plurality of fastening means. The air valve is connected to the safety switch through the first safety tube.

The can crushing apparatus is designed to connect with an external air compressor. When the push button switch is pressed, the air compressor releases compressed air. The first air tube receives the compressed air released by the air compressor through the first top end connected to the air compressor. The air valve receives the compressed air through the first bottom end of the first air tube. The second top end is connected to the upper portion of the piston and the second bottom end is connected to the air valve. The second bottom end receives the compressed air from the air valve and transfers the compressed air to the second bottom end. The second bottom end transfers the compressed air to the upper portion of the piston. The compressed air causes the hammer to extend towards the downward direction for crushing the can placed in the can holding plate. The third bottom end connected to the air valve transfers the compressed air to the third top end connected to the lower portion of the piston. The compressed air at the lower portion of the piston pushes the hammer in the upward direction to restore the original position of the hammer.

The fourth top end of the fourth air tube is connected to the air valve and the fourth bottom end is connected to the can holding plate. The fourth top end receives the compressed air from the air valve and transfers the compressed air to the fourth bottom end for directing the crushed can towards the deflector guide. The deflector guide transfers the crushed can to a can collecting bin. The safety switch prevents hand injuries caused by the accidental positioning of hands by a user on the crusher.

These and other advantages and features of the present invention are described with specificity so as to make the present invention understandable to one of ordinary skill in the art.

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
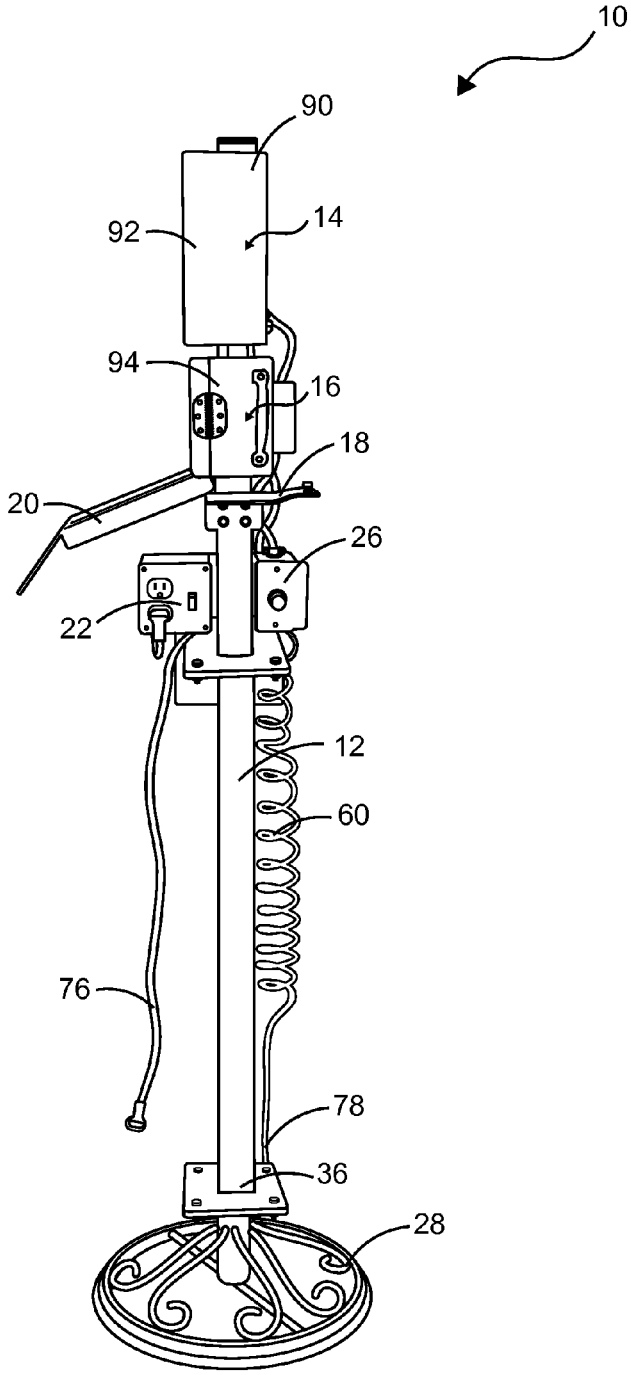
FIG. 1 is a perspective view of the present embodiment, illustrating a can crushing apparatus.

As shown in FIG. 1, a perspective view of a can crushing apparatus 10 for crushing a can 88 (FIG. 2) is illustrated. The can crushing apparatus 10 comprises an elongated structure 12, a piston drive assembly 14, a can crushing chamber 16, a can holding plate 18, a deflector guide 20, a control 22, a safety switch 24 (FIG. 2), a push button switch 26 and an attachment means 28.

Figure 2:
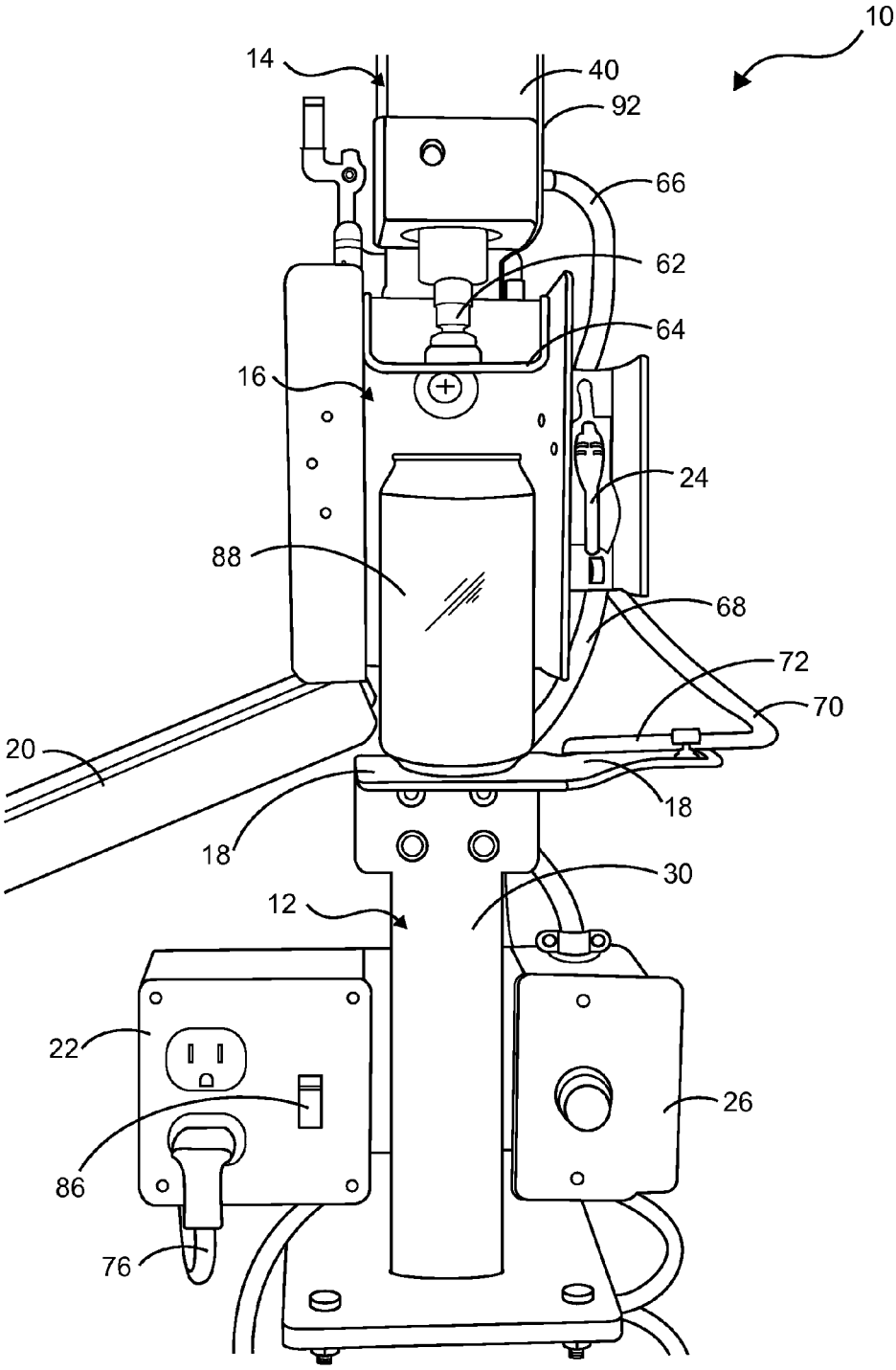
FIG. 2 is a perspective view of the present embodiment, illustrating a piston drive assembly and a can crushing chamber of the can crushing apparatus.
Figure 3:
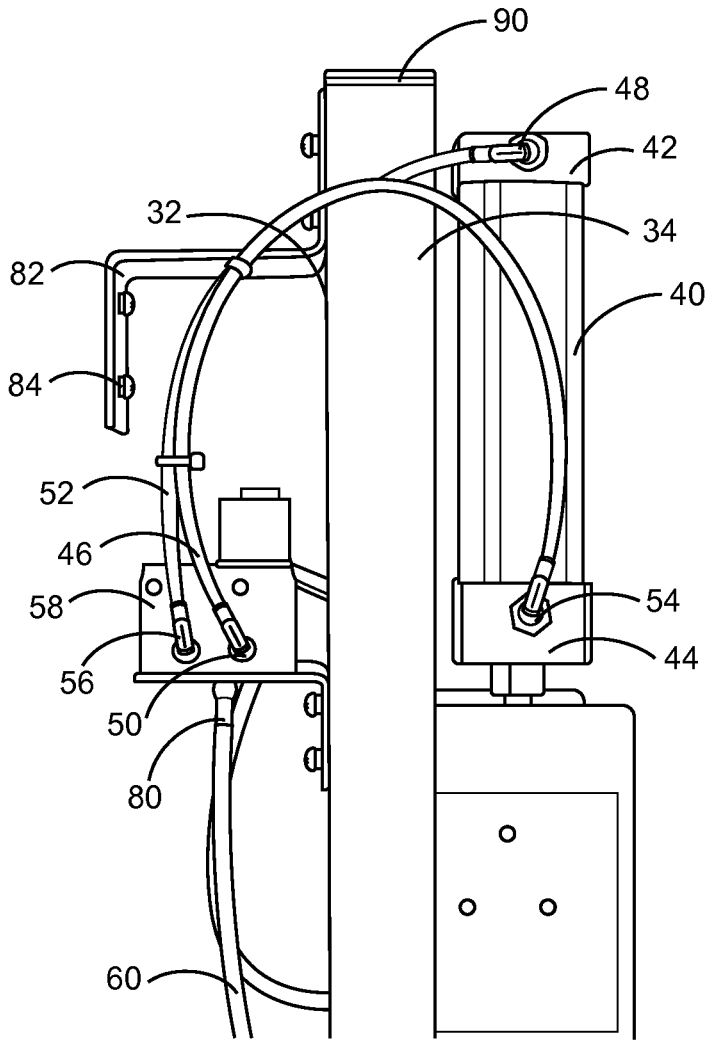
FIG. 3 is a perspective view of the present embodiment, illustrating an air valve, a second air tube and a third air tube of the can crushing apparatus.
Figure 4:
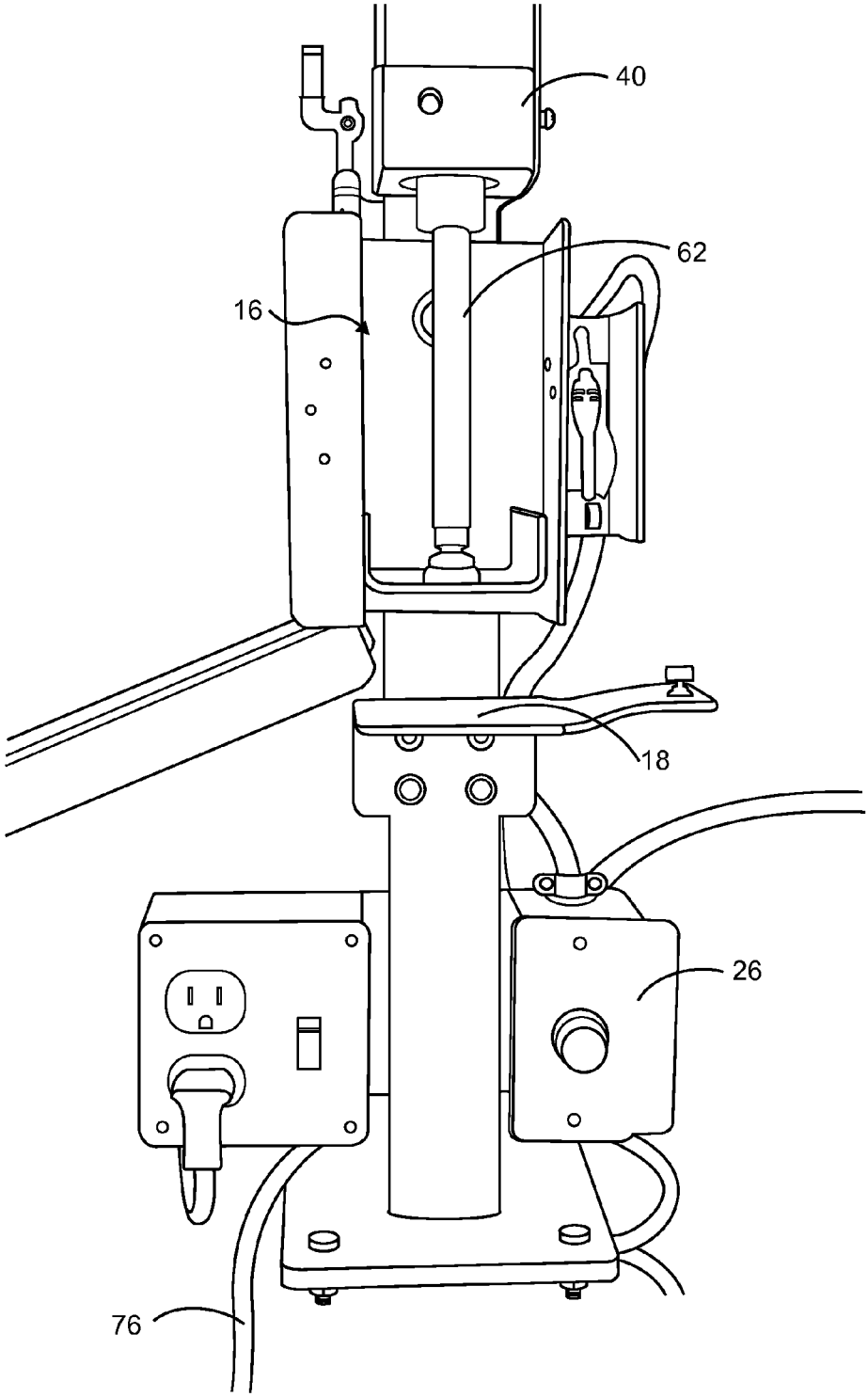
FIG. 4 is a perspective view of the present embodiment, illustrating a hammer of the piston drive assembly in an extended position.

Referring to FIGS. 2-4, the elongated structure 12 includes a front wall 30, a rear wall 32, a pair of side walls 34, a top portion 90 and a bottom portion 36. The piston drive assembly 14 is attached with the front wall 30 and includes a piston 40 designed to crush the can 88. The piston 40 includes a hammer 62 attached with a hammer plate 64, a cylindrical housing 92 for securing the piston 40, an upper portion 42 and a lower portion 44. The hammer 62 is extendable in a downward direction and retractable in an upward direction. The can crushing chamber 16 is attached with the front wall 30 and includes a door 94. The can holding plate 18 is designed to securely hold the can 88 to be crushed. The deflector guide 20 is designed to transfer a crushed can 88 to a can collecting bin (not shown). The control 22 provides electric power to the can crushing apparatus 10. The control 22 includes an on/off switch 86 for selectively turning the control 22 on or off and further includes a cable 76 for electrically connecting the control 22 to an external power supply.

The safety switch 24 is attached with the can crushing chamber 16. The safety switch 24 includes a first safety tube 66 and a second safety tube 68. The safety switch 24 becomes activated when the door 94 of the can crushing chamber 16 becomes completely closed. Similarly, the safety switch 24 becomes deactivated when the door 94 is in an open condition. The safety switch 24, when activated, supplies the electric power to the can crushing apparatus 10. The push button switch 26 is electrically connected to the safety switch 24 through the second safety tube 68. The can crushing apparatus 10 further comprises a first air tube 60 having a first top end 78 and a first bottom end 80, an air valve 58, a second air tube 52 having a second top end 48 and a second bottom end 56, a third air tube 46 having a third top end 54 and a third bottom end 50, a fourth air tube 70 having a fourth top end 74 (FIG. 6) and a fourth bottom end 72 and a plurality of fastening means 82. The air valve 58 is connected to the safety switch 24 through the first safety tube 66. The plurality of fastening means 82 is utilized to mount the can crushing apparatus 10 on a vertical surface like a wall. The plurality of fastening means 82 is anchored on the wall using anchors like screws and bolts 84. The can crushing apparatus 10 require only less space for storage because of its vertical structure.

The can crushing apparatus 10 is connected to an external air compressor (not shown). When the push button switch 26 is pressed, the external air compressor (not shown) releases compressed air. The first air tube 60 receives the compressed air released by the air compressor (not shown) through the first top end 78 connected to the air compressor (not shown). The air valve 58 receives the compressed air through the first bottom end 80 of the first air tube 60. The second top end 48 of the second air tube 52 is connected to an upper portion 42 of the piston 40 and the second bottom end 56 of the second air tube 52 is connected to the air valve 58. The second bottom end 56 receives the compressed air from the air valve 58 and transfers it to the second top end 48. The second top end 48 transfers the compressed air to the upper portion 42 of the piston 40. As shown in FIG. 4, the compressed air causes the hammer 62 to extend towards downward direction through the can crushing chamber 16 for crushing the can 88 placed in the can holding plate 18. The third bottom end 50 connected to the air valve 58 transfers the compressed air to the third top end 54 connected to the lower portion 44 of the piston 40. The compressed air at the lower portion 44 of the piston 40 pushes the hammer 62 in the upward direction to restore the original position of the hammer 62.

Figure 5:
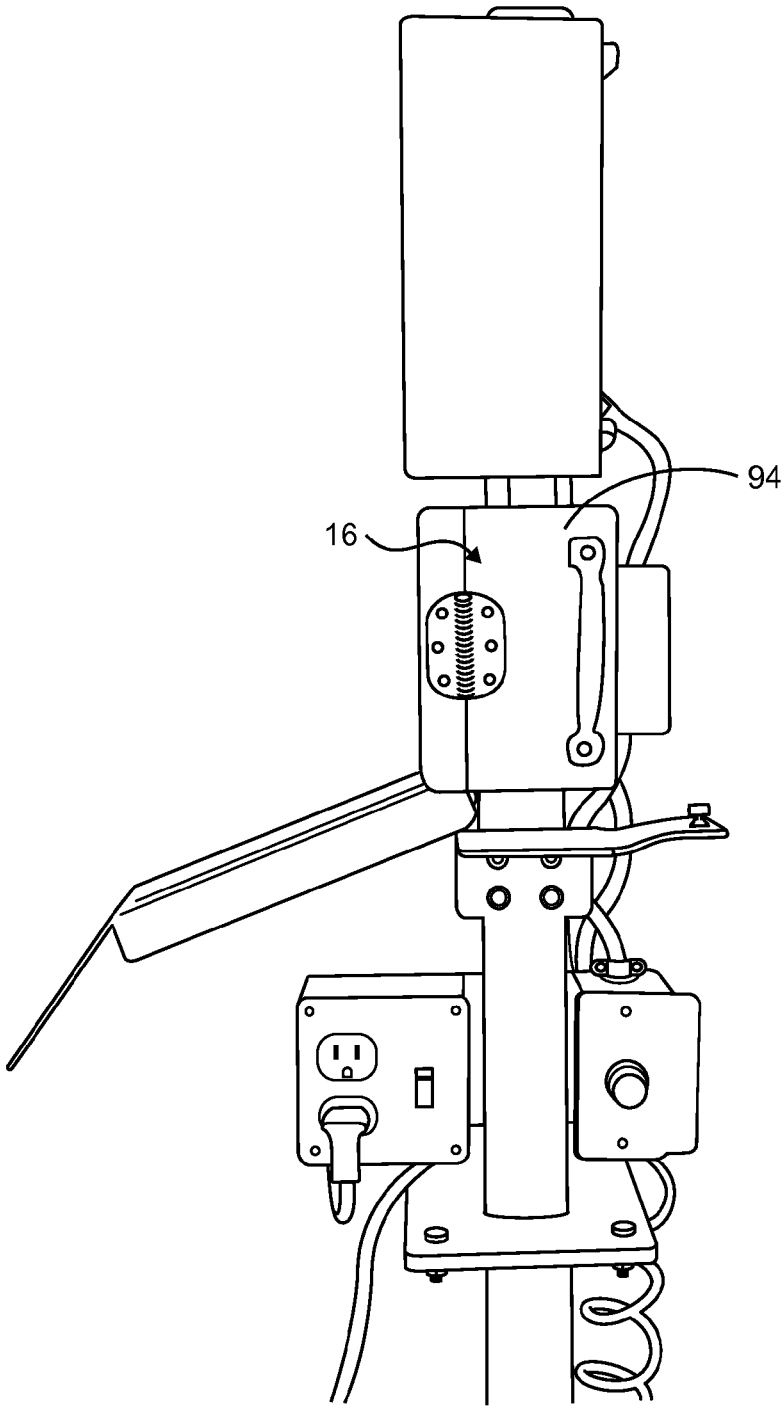
FIG. 5 is a perspective view of the present embodiment, illustrating the can crushing chamber in a closed position.
Figure 6:
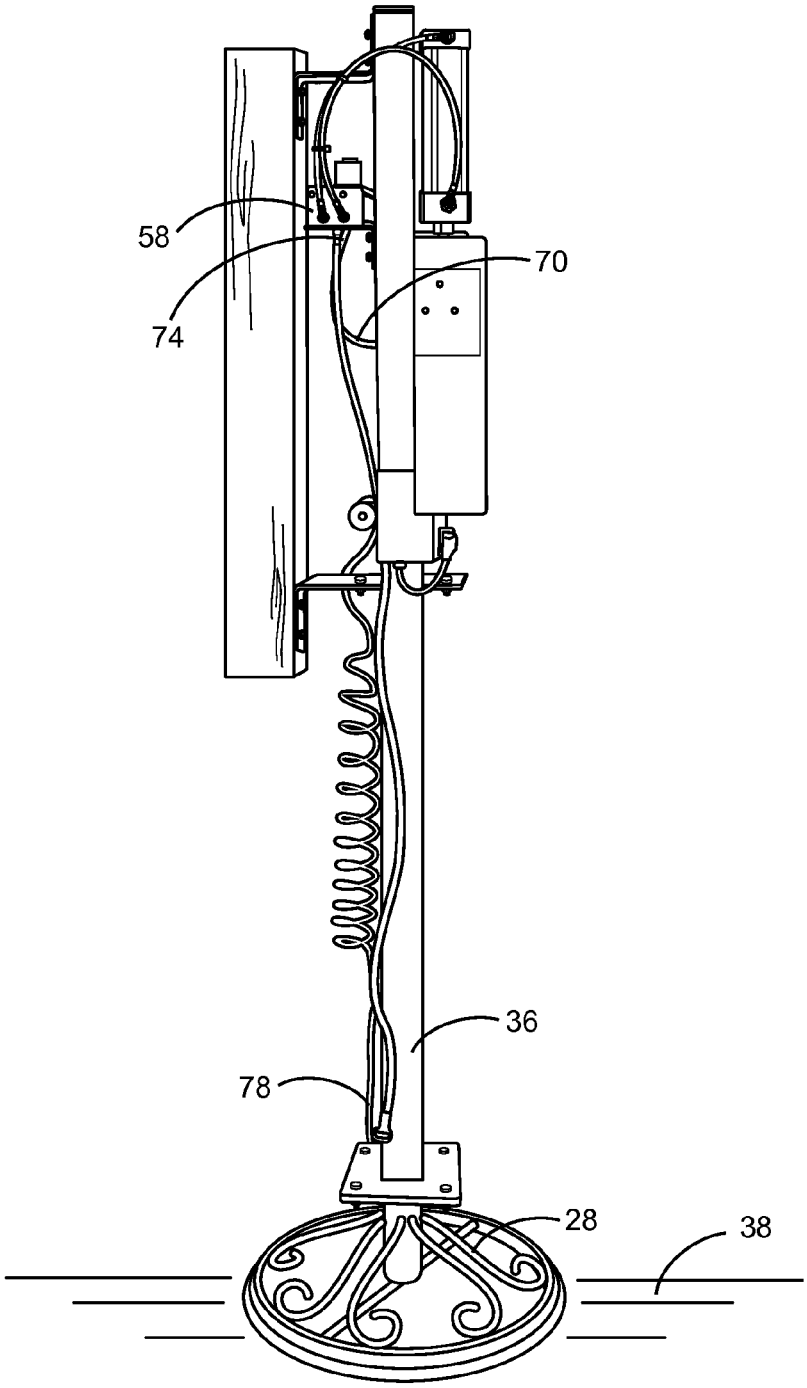
FIG. 6 is a right side perspective view of the present embodiment, illustrating an attachment means of the can crushing apparatus.
Figure 7:
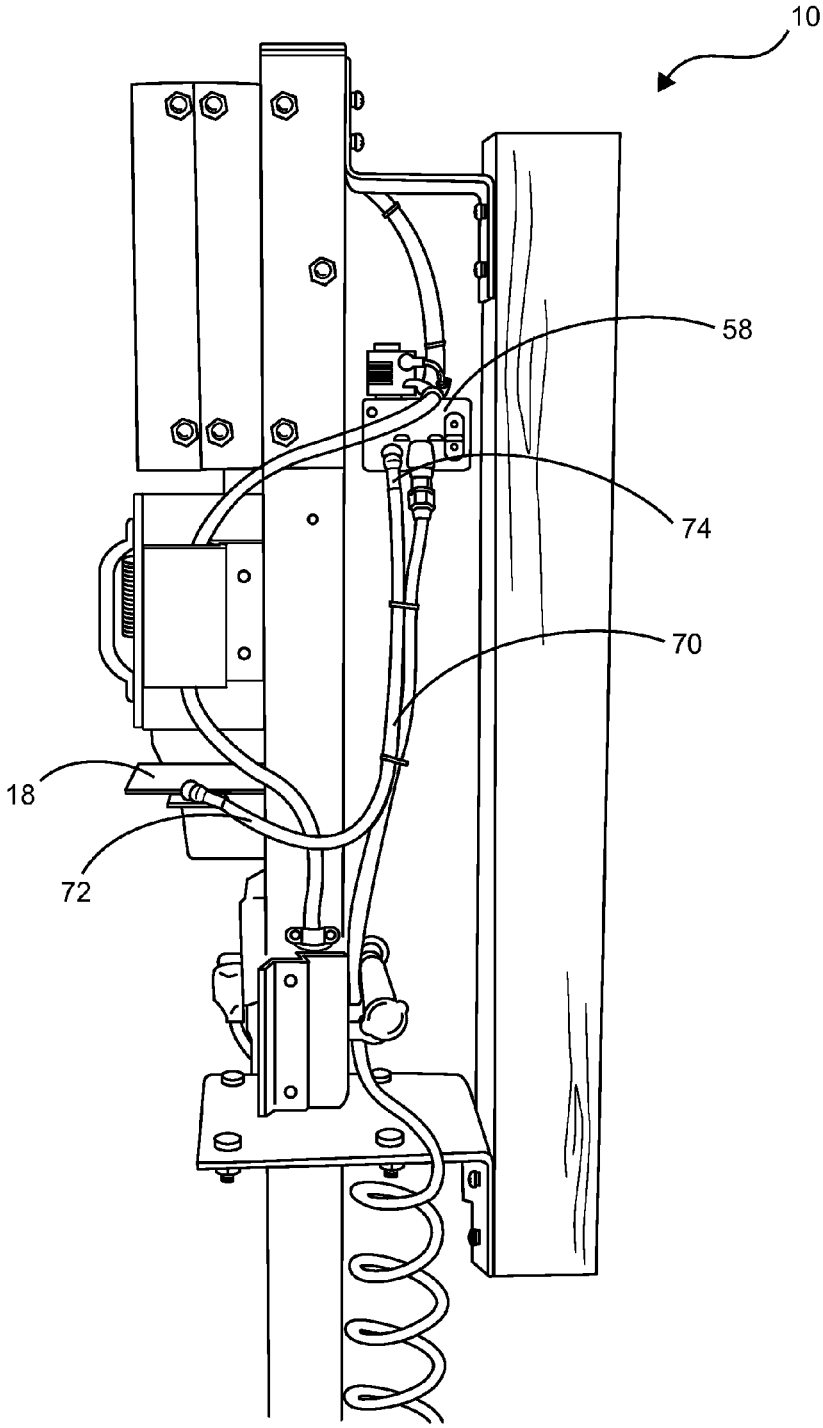
FIG. 7 is a left side perspective view of the present embodiment, illustrating the third air tube and a fourth air tube of the can crushing apparatus.

FIG. 5 shows the can crushing chamber 16 in a closed condition. The safety switch 24 becomes activated only if the door 94 is completely closed. The safety switch 24 prevents hand injuries caused by the accidental positioning of hands by a user on the can crushing apparatus 10. Referring to FIGS. 6-7, the attachment means 28 allows the can crushing apparatus 10 to be attached on a horizontal surface 38. The fourth top end 74 of the fourth air tube 70 is connected to the air valve 58 and the fourth bottom end 72 is connected to the can holding plate 18. The fourth top end 74 receives the compressed air from the air valve 58 and transfers the compressed air to the fourth bottom end 72 for directing the crushed can 88 towards the deflector guide 20. The deflector guide 20 transfers the crushed can 88 to the can collecting bin (not shown).

In use, the first top end 78 of the first air tube 60 is connected to the air compressor (not shown) and the first bottom end 80 of the first air tube 60 is connected to the air valve 58. The second top end 48 of the second air tube 52 is connected to the upper portion 42 of the piston 40 and the second bottom end 56 of the second air tube 52 is connected to the air valve 58. The third top end 54 of the third air tube 46 is connected to the lower portion 44 of the piston 40 and the third bottom end 50 of the third air tube 46 is connected to the air valve 58. The fourth top end 74 of the fourth air tube 70 is connected to the air valve 58 and the fourth bottom end 72 of the fourth air tube 70 is connected to the can holding plate 18. The safety switch 24 is activated by closing the door 94 of the can crushing chamber 16. The push button switch 26 is pushed for releasing the compressed air from the air compressor (not shown). The compressed air is then transferred through the first air tube 60. Thereafter, the compressed air is transferred from the air valve 58 to the upper portion 42 of the piston 40 through the second air tube 52. The hammer 62 of the piston 40 is extended to the downward direction through the can crushing chamber 16 for crushing the can 88 located in the can holding plate 18. Next, the hammer 62 is pushed in an upward direction utilizing the compressed air filled in the third air tube 46. The compressed air is released through the fourth bottom end 72 of the fourth air tube 70 to transfer the crushed can 88 from the can holding plate 18 to the can deflector guide 20. Finally, the crushed can 88 is directed from the deflector guide 20 to the can collecting bin (not shown).

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A can crushing apparatus comprising:

an elongated structure having a top portion and a bottom portion;

a piston drive assembly having a piston designed to crush a can, said piston includes a hammer, a cylindrical housing for securing said piston, an upper portion and a lower portion, said hammer being extendable in a downward direction and retractable in an upward direction;

a can crushing chamber having a door;

a can holding plate designed to hold said can;

a deflector guide for transferring a crushed can to a can collecting bin;

a control for providing electric power to said can crushing apparatus, said control includes an on/off switch for selectively turning said control on or off and a cable for electrically connecting said control to an external power supply;

a safety switch attached with said can crushing chamber, said safety switch includes a first safety tube and a second safety tube, said safety switch becomes activated when said door of said can chamber becomes closed;

a push button switch for releasing compressed air from an air compressor, said push button switch being electrically connected to said safety switch through said second safety tube;

a first air tube for transferring said compressed air released by said air compressor, said first air tube includes a first top end and a first bottom end, said first top end connected to said air compressor;

an air valve for receiving said compressed air through said first bottom end of said first air tube, said air valve being connected to said safety switch through said first safety tube;

a second air tube having a second top end and a second bottom end, said second top end being connected to said upper portion of said piston and said second bottom end being connected to said air valve, said second air tube transfers said compressed air from said air valve to said upper portion of said piston and said compressed air extends said hammer in said downward direction through said can crushing chamber for crushing said can placed in said can holding plate;

a third air tube having a third top end and a third bottom end, said third top end being connected to said lower portion of said piston and said third bottom end being connected to said air valve, said third air tube transfers said compressed air from said air valve to said lower portion of said hammer thereby pushing said hammer in said upward direction;

a fourth air tube having a fourth top end connected to said air valve and a fourth bottom end connected to said can holding plate, said fourth top end receives said compressed air from said air valve and transfers said compressed air to said fourth bottom end for directing said crushed can towards said deflector guide, said deflector guide transfers said crushed can to said can collecting bin;

an attachment means for attaching said can crushing apparatus on a horizontal surface; and a plurality of fastening means for mounting said can crushing apparatus on a vertical surface;

whereby said push button switch releases said compressed air from said air compressor to push said hammer in said downward direction for crushing said can positioned at said can holding plate and said compressed air filled in said fourth air tube directs said crushed can to said can collecting bin through said deflector guide.

2. The can crushing apparatus of claim 1 wherein said can crushing apparatus is wall mountable.

3. The can crushing apparatus of claim 1 wherein said safety switch becomes deactivated when said door is in an open condition.

4. The can crushing apparatus of claim 1 wherein said elongated structure includes a front wall, a rear wall and a pair of side walls.

5. The can crushing apparatus of claim 4 wherein said piston drive assembly is attached with said front wall.

6. The can crushing apparatus of claim 1 wherein said hammer is attached with a hammer plate.

7. The can crushing apparatus of claim 1 wherein said can crushing chamber is attached with said front wall.

8. The can crushing apparatus of claim 1 wherein said safety switch activates said control for supplying power to said can crushing apparatus when said door is in a closed position.

9. A can crushing apparatus comprising:

an elongated structure having a front wall, a rear wall, a pair of side walls, a top portion and a bottom portion;

a piston drive assembly attached with said front wall, said piston drive assembly includes a piston designed to crush a can, said piston includes a hammer attached with a hammer plate, a cylindrical housing for securing said piston, an upper portion and a lower portion, said hammer being extendable in a downward direction and retractable in an upward direction;

a can crushing chamber attached at said front wall, said can crushing chamber includes a door;

a can holding plate designed to hold said can;

a deflector guide for transferring a crushed can to a can collecting bin;

a control for providing electric power to said can crushing apparatus, said control includes an on/off switch for selectively turning said control on or off and a cable for electrically connecting said control to an external power supply;

a safety switch attached with said can crushing chamber, said safety switch includes a first safety tube and a second safety tube, said safety switch becomes activated when said door of said can chamber becomes closed, said safety switch being designed to activate said control for supplying said electric power to said can crushing apparatus;

a push button switch for releasing compressed air from an air compressor, said push button switch being electrically connected to said safety switch through said second safety tube;

a first air tube for transferring said compressed air released by said air compressor, said first air tube includes a first top end connected to said air compressor and a first bottom end;

an air valve for receiving said compressed air through said first bottom end of said first air tube, said air valve being connected to said safety switch through said first safety tube;

a second air tube having a second top end and a second bottom end, said second top end being connected to said upper portion of said piston and said second bottom end being connected to said air valve, said second air tube transfers said compressed air from said air valve to said upper portion of said piston and said hammer extends in said downward direction through said can crushing chamber to crush said can placed in said can holding plate;

a third air tube having a third top end and a third bottom end, said third top end being connected to said lower portion of said piston and said third bottom end being connected to said air valve, said third air tube transfers said compressed air from said air valve to said lower portion of said piston to push said hammer in said upward direction;

a fourth air tube having a fourth top end connected to said air valve and a fourth bottom end connected to said can holding plate, said fourth top end receives said compressed air from said air valve and transfers said compressed air to said fourth bottom end for directing said crushed can towards said deflector guide, said deflector guide transfers said crushed can to said can collecting bin;

an attachment means for attaching said can crushing apparatus on a horizontal surface; and a plurality of fastening means for mounting said can crushing apparatus on a vertical surface;

whereby said push button switch releases said compressed air from said air compressor to push said hammer in said downward direction for crushing said can positioned at said can holding plate and said compressed air filled in said fourth air tube directs said crushed can to said can collecting bin through said deflector guide.

10. The can crushing apparatus of claim 9 wherein said can crushing apparatus is wall mountable.

11. The can crushing apparatus of claim 9 wherein said safety switch becomes deactivated when said door is in an open condition.

12. A method for crushing a can, the method comprising the steps of:

(a) providing a can crushing apparatus having an elongated structure, a piston drive assembly, a can crushing chamber, a can holding plate, a deflector guide, a control, a safety switch, a push button switch, a first air tube, an air valve, a second air tube, a third air tube, a fourth air tube, an attachment means and a plurality of fastening means;

(b) connecting a first top end of said first air tube to an air compressor and a first bottom end of said first air tube to said air valve;

(c) connecting a second top end of said second air tube to an upper portion of said piston and a second bottom end of said second air tube to said air valve;

(d) connecting a third top end of said third air tube to a lower portion of said piston and a third bottom end of said third air tube to said air valve;

(e) connecting a fourth top end of said fourth air tube to said air valve and a fourth bottom end of said fourth air tube to said can holding plate;

(f) activating said safety switch by closing a door of said can crushing chamber;

(g) pushing said push button switch for releasing compressed air from said air compressor;

(h) transferring said compressed air through said first air tube;

(i) transferring said compressed air from said air valve to a upper portion of said piston through said second air tube;

(j) extending a hammer of said piston in a downward direction through said can crushing chamber for crushing said can located in said can holding plate;

(k) pushing said hammer in an upward direction utilizing said compressed air filled in said third air tube;

(l) releasing said compressed air through a fourth bottom end of said fourth air tube to transfer said crushed can from said can holding plate to said can deflector guide; and (m) directing said crushed can from said deflector guide to a can collecting bin.

13. The method of claim 12 wherein said can crushing apparatus is wall mountable.

14. The method of claim 12 wherein said can crushing apparatus utilizes said plurality of fastening means for mounting said can crushing apparatus on a wall.

15. The method of claim 12 wherein said safety switch becomes deactivated when said door is in an open condition.

* * * * *